US008101028B2

(12) United States Patent
Heiβler et al.

(10) Patent No.: US 8,101,028 B2
(45) Date of Patent: Jan. 24, 2012

(54) DISHWASHER WITH AN AUTOMATICALLY REGULATED DRYING PROCESS

(75) Inventors: Heinz Heiβler, Dillingen (DE); Helmut Jerg, Giengen (DE); Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 989 days.

(21) Appl. No.: 10/580,579

(22) PCT Filed: Nov. 24, 2004

(86) PCT No.: PCT/EP2004/053084

§ 371 (c)(1),
(2), (4) Date: Feb. 16, 2007

(87) PCT Pub. No.: WO2005/051160

PCT Pub. Date: Jun. 9, 2005

(65) Prior Publication Data

US 2007/0240738 A1 Oct. 18, 2007

(30) Foreign Application Priority Data

Nov. 27, 2003 (DE) ..... 103 55 428

(51) Int. Cl.
*B08B 9/20* (2006.01)

(52) U.S. Cl. ..... 134/56 D; 134/18; 134/25.2; 134/57 D

(58) Field of Classification Search ..... 134/18, 134/56 D, 57 D, 58 D, 105
See application file for complete search history.

(56) References Cited

U.S. PATENT DOCUMENTS 5,331,984 A * 7/1994 Isagawa ..... 134/57 D

FOREIGN PATENT DOCUMENTS

| | | | |
|---|---|---|---|
| DE | 42 30 576 | | 3/1994 |
| EP | 1 127 532 | | 8/2001 |
| EP | 1 344 487 | | 9/2003 |
| JP | 01141642 | A * | 6/1989 |
| JP | 1-265932 | | 10/1989 |
| JP | 4-53522 | | 2/1992 |
| JP | 2515420 | B2 * | 7/1996 |
| JP | 9-94212 | | 4/1997 |
| JP | 10-258014 | | 9/1998 |

OTHER PUBLICATIONS

Abstract: JP 01-141642 A to Asai, Takahiro. Jun. 1989.*
Machine Translation: JP 2515420 B2 to Okamoto et al. Jul. 1996.*
Translation of abstract for JP 10-258014 by Nakajima, published Sep. 29, 1998.*
USPTO's Human Translation of JP01-141642 to Asai, published Jun. 1989.*
International Search Report PCT/EP2004/053084.

* cited by examiner

*Primary Examiner* — Michael Kornakov
*Assistant Examiner* — Ryan Coleman
(74) *Attorney, Agent, or Firm* — James E. Howard; Andre Pallapies

(57) ABSTRACT

A dishwasher is provided having a washing container for retaining therein objects to be washed by the dishwasher and a system for drying objects to be washed. The system for drying objects to be washed includes a heat generator for heating at least part of the air present in the dishwasher and a humidity sensor that detects the humidity of at least part of the air present in the dishwasher, such that only the amount of energy that is actually required for optimal drying is supplied in the form of heat energy for drying.

9 Claims, No Drawings

DISHWASHER WITH AN AUTOMATICALLY REGULATED DRYING PROCESS

BACKGROUND OF THE INVENTION

The present invention relates to a dishwasher comprising a system for drying objects to be washed in the dishwasher and a method for operating the same.

In the course of the washing operation in a dishwasher, one or several washing processes are usually carried out to clean the objects for washing located in the dishwasher. The last washing process is usually followed by a clear rinsing phase followed by a drying process to dry the objects to be washed. Different drying systems are known for drying objects to be washed in a dishwasher.

For example, the objects to be washed can be dried by own-heat drying using a heat exchanger, whereby the rinsing liquid for the clear rinsing is heated and thus objects to be washed which have undergone a hot clear rinse are dried by themselves as a result of the own heat of said objects to be washed which has thus built up during the drying process. In order to achieve this own heat drying, the clear rinsing liquid is heated to a certain temperature in the heat exchanger and applied to the objects to be washed by means of spray devices provided in the dishwasher. As a result of the relatively high temperature of the clear rinsing liquid usually of 65° C. to 70° C., it is achieved that a sufficiently large amount of heat is transferred to the objects to be washed so that water adhering to the objects to be washed is evaporated by heat stored in the objects to be washed.

In a further known drying device, a separate heat source, e.g. a hot air blower, is used in the washing container to heat the moist air mixture during the drying process so that the air in the washing container can absorb a larger quantity of water.

A disadvantage of the drying systems according to the prior art described above is that the drying processes are carried out without taking into account the type and quantity of the objects to be washed located in the dishwasher, which can have the result that the drying process lasts longer than is necessary whereby unnecessary thermal energy is wasted. However, it is particularly disadvantageous if the drying process is too short so that the objects to be washed located in the dishwasher are not yet completely dried after the end of the drying process.

SUMMARY OF THE INVENTION

It is thus the object of the present invention to provide a drying system by means of which it is possible to efficiently dry the wet objects to be washed located in the washing container whilst taking into account economic considerations.

This object is solved by the dishwasher and method according to the invention having the features described herein.

DETAILED DESCRIPTION OF TECHNOLOGY

In the dishwasher according to the invention, a system for drying objects to be washed is provided with heat generating means for heating at least part of the air present in the dishwasher, wherein a humidity sensor detects the humidity of at least part of the air present in the dishwasher.

Accordingly, in the method according to the invention for cleaning and drying objects to be washed in dishwashers, wherein a cleaning rinsing or clear rinsing process is followed by a drying process, at least some of the air present in the dishwasher is heated by heat generating means, wherein the humidity of at least some of the air present in the dishwasher is detected by a humidity sensor during the drying process.

In a dishwasher with a drying system according to the present invention, the humidity of the air inside the dishwasher and thus, the degree of drying of the objects to be washed is determined by means of a humidity sensor during the drying phase. The humidity of the air in the dishwasher determined by the humidity sensor is then used in the drying system to optimise the drying process whereby, for example, further thermal energy is supplied to the air in the dishwasher if necessary by means of the heat generating means or the operation of the heat generating means is ended. This evaluation of the humidity value determined and ensuing regulation of the heat generating means is preferably carried out by an electronic controller. However, it would also be feasible for the humidity value determined by the humidity sensor during the drying process to be indicated by means of suitable display means and the operator independently adjusts or ends the drying process as a result of the indicated humidity value.

During the drying phase 100% moisture-saturated air is usually present in the dishwasher while objects to be washed are not completely dried. For example, the drying process can thus be regulated so that as long as the drying phase is not completed, energy continues to be supplied by means of the heat generating means such as, for example, a hot air blower or a heat exchanger to accelerate the drying of the objects to be washed. The drying system can only stop operating when the humidity sensor has determined that the air moisture in the dishwasher has fallen below 100% saturation or to a certain degree of saturation. This "after-heating" optimally lasts until the desired degree of drying is reached.

A dishwasher with the system according to the invention for drying objects to be washed thus has the advantage that the drying time can be individually adjusted and regulated to the type and quantity of objects to be washed located in the dishwasher. In this way, only the amount of energy in the form of thermal energy for the drying, which is actually required for optimal drying, is supplied whereby energy can be saved. A further advantage of the drying system according to the invention is a particularly gentle drying process, whereby the influences of stress on the objects to be washed are reduced, which is especially desirable for ceramics or earthenware vessels.

The principle forming the basis of the present invention is consequently to undertake automatic regulation even during the drying process.

Hitherto, various sensors or measuring sensors were only used in dishwashers to monitoring the washing operation, such as for example the use of a water-sensitive sensor which measures the level of the washing liquid during the cleaning process or the number of changes of water and the washing times. With the drying system according to the present invention it is now possible to monitor and regulate the drying phase whereby the drying process is monitored by sensor monitoring and the drying process can be regulated on the basis of the measured values actually determined during the drying process.

In a further advantageous embodiment of the present invention, the humidity sensor is arranged in a washing container of the dishwasher so that the humidity sensor can detect the humidity of the air located in the washing container in the immediate proximity of the washed objects to be dried. The humidity sensor is preferably arranged in the upper area of the dishwasher since the humidity of the rising warm air can best be detected there.

More appropriate, the drying process is regulated depending on the humidity determined by the humidity sensor. That is, the operation of the heat-generating means is regulated according to the determined air humidity by an electronic controller so that the heat generating means only produces the amount of heat required. Furthermore, the drying process can be ended depending on the humidity determined by the humidity sensor. That is, the drying process is only carried out until the desired degree of drying or a sufficient drying of the objects to be washed has been reached.

The invention claimed is:

1. A dishwasher comprising:

a washing container to retain therein objects to be washed by the dishwasher; and a system to dry objects to be washed, the system including a heater to heat at least part of the air present in the dishwasher and a humidity sensor to detect the humidity of at least part of the air present in the dishwasher, wherein the system for drying the objects to be washed includes a display to indicate the humidity determined by the humidity sensor while the humidity sensor is sensing the humidity of air present in the dishwasher; and wherein the system is switchable to an off position by an operator in an independent manner as a function of the humidity determined by the humidity sensor and indicated on the display.

2. The dishwasher according to claim 1, wherein the system for drying the objects to be washed includes an electronic controller to control the display as a function of the humidity determined by the humidity sensor.

3. The dishwasher according to claim 1, wherein the humidity sensor is arranged in the washing container of the dishwasher.

4. The dishwasher according to claim 1, wherein the humidity sensor is arranged in an upper area of the dishwasher.

5. A method for cleaning and drying objects in a dishwasher, the method comprising:

subjecting the objects to at least one rinsing process;

after the at least one rinsing process, subjecting the objects to a drying process, wherein at least some of the air present in the dishwasher is heated by a heater;

detecting the humidity of at least some of the air present in the dishwasher by a humidity sensor during the drying process;

displaying the detected humidity on a display; and controlling the drying process in an independent manner as a function of the detected humidity and the humidity indicated on the display.

6. The method for drying objects in a dishwasher according to claim 5, wherein the drying process is controlled as a function of the humidity determined by the humidity sensor by means of a non-electronic or an electronic controller.

7. The method for drying objects in a dishwasher according to claim 5, wherein the drying process is ended as a function of the humidity determined by the humidity sensor.

8. The method for drying objects in a dishwasher according to claim 5, wherein the operation of the heater is controlled as a function of the humidity determined by the humidity sensor.

9. The method for drying objects in a dishwasher according to claim 5, wherein the operation of the heater is ended as a function of the humidity determined by the humidity sensor.

* * * * *